US006164752A

United States Patent [19]

Schaefer et al.

[11] Patent Number: 6,164,752

[45] Date of Patent: Dec. 26, 2000

[54] INK JET PRINT HEAD MAINTENANCE METHOD

[75] Inventors: David B. Schaefer, Wilsonville; Edward F. Burress; Timothy R. Golik, both of Portland; Ernest I. Esplin, Sheridan, all of Oreg.

[73] Assignee: Xerox Corporation, Stamford, Conn.

[21] Appl. No.: 09/188,016

[22] Filed: Nov. 6, 1998

[51] Int. Cl.[7] ..... B41J 2/165

[52] U.S. Cl. ..... 347/30

[58] Field of Search ..... 347/30, 33, 29

[56] References Cited

U.S. PATENT DOCUMENTS

| | | | |
|---|---|---|---|
| 4,727,378 | 2/1988 | Le et al. | 346/1.1 |
| 4,970,535 | 11/1990 | Oswald et al. | 346/140 |
| 5,138,334 | 8/1992 | Rowe et al. | 347/33 |
| 5,184,147 | 2/1993 | MacLane et al. | 346/1.1 |
| 5,381,168 | 1/1995 | Kondo et al. | 347/30 |
| 5,570,116 | 10/1996 | Soga | 347/30 |
| 5,570,117 | 10/1996 | Karambelas et al. | 347/33 |
| 5,648,803 | 7/1997 | Koyama et al. | 347/30 |
| 5,677,718 | 10/1997 | Crawford et al. | 347/92 |
| 5,701,146 | 12/1997 | Akiyama et al. | 347/26 |
| 5,717,444 | 2/1998 | Sugimoto et al. | 347/29 |
| 5,781,204 | 7/1998 | Kanematsu et al. | 347/17 |
| 5,781,212 | 7/1998 | Burr et al. | 347/84 |
| 5,784,081 | 7/1998 | Ozaki et al. | 347/30 |

*Primary Examiner*—N. Le
*Assistant Examiner*—Shih-Wen Hsieh

[57] ABSTRACT

A method for purging an ink jet print head to clear ink jet orifices is provided. A purge cap forms a vacuum seal over the orifice plate of the print head. Multiple low pressure differential vacuum pulses are applied to the purge cap to remove debris and trapped air bubbles from the ink jet orifices. The low pressure pulses avoid cavitation inside the print head and reduce the amount of ink expelled during the purging process.

10 Claims, 5 Drawing Sheets

INK JET PRINT HEAD MAINTENANCE METHOD

FIELD OF INVENTION

This invention relates generally to a method for cleaning an ink jet print head and, more specifically, to an improved method of applying multiple low pressure differential vacuum pulses to remove debris and trapped air bubbles from the print head.

BACKGROUND OF THE INVENTION

Certain types of ink jet printers typically create a printed image by ejecting ink through orifices contained in an ink jet print head onto an image receiving medium. The image receiving medium may take the form of a sheet of media or an intermediate transfer drum that transfers the image to a sheet of media. Repeated printing builds up contaminates, such as unused ink and debris from the print medium, in the orifices and on the orifice plate. To ensure a high quality printed image, the print head must be periodically cleaned of this contamination to provide an unhindered ink trajectory from the orifices.

A typical conventional cleaning sequence, or print head maintenance cycle, entails drawing ink and debris from the orifices onto the orifice plate and then wiping the orifice plate. One example of a conventional cleaning sequence is disclosed in U.S. Pat. No. 5,570,117 entitled PRINT HEAD MAINTENANCE METHOD AND APPARATUS WITH RETRACTABLE WIPER, and assigned to the assignee of the present application. This cleaning sequence involves placing a sealable cap over the print head orifice plate and providing a single, limited duration vacuum within the cap by the activation of a separate vacuum reservoir, pump and activation valve. The vacuum draws trapped gasses and ink from the print head through the print head jet orifices.

In one prior art example of practicing the above cleaning sequence, the peak vacuum pressure utilized is in the range of −10 psig or greater, with "greater" corresponding to a greater negative valve, such as a −12 psig. The duration of the vacuum is approximately 0.375 seconds. A decaying vacuum profile follows the peak vacuum pressure for approximately 6–10 seconds until ambient pressure is achieved. A wiping action across the orifice plate is then used to remove excess ink from the surface of the orifice plate. In this example, the purge efficiency of the cleaning sequence is approximately 75%, with "purge efficiency" being defined as the percentage of time that the cleaning sequence succeeds in clearing all of the print head jets for proper operation.

The prior art print head maintenance cycle described above has several disadvantages. Utilizing a single vacuum pulse requires a higher peak vacuum pressure to achieve an acceptable purge performance. This higher peak vacuum pressure can cause cavitation in the print head and lead to the introduction of air bubbles or gasses pulled from ink solution. The process of forming the seal between the purge cap and the orifice plate can also force air into the orifices. It would also be desirable to improve the purging efficiency and reduce the amount of ink utilized in the maintenance cycle. Accordingly, a need exists for an improved print head maintenance method that cleans a print head while overcoming the disadvantages of the prior art.

SUMMARY OF THE INVENTION

It is an aspect of the present invention to provide an improved method for cleaning an ink jet print head.

It is another aspect of the present invention to provide an improved method for utilizing a purge cap and vacuum pressure to draw contaminants from orifices in an orifice plate.

It is a feature of the present invention that the method utilizes multiple low pressure differential vacuum pulses to improve purging efficiency and reduce the amount of ink required to perform cleaning.

It is another feature of the present invention that the method creates pre-purge suction prior to forming a seal around the orifice plate to avoid introducing air bubbles into the orifices.

It is yet another feature of the present invention that the method requires fewer user interventions to empty waste ink receptacles or refill ink supplies.

It is still another feature of the present invention that the method utilizes a single sealing action of the purge cap to the print head to reduce the required motion of the purge cap assembly and further minimize the introduction of air into the orifices.

It is an advantage of the present invention that the method requires reduced amounts of ink to perform the purging process.

It is another advantage of the present invention that the method utilizes a lower peak vacuum pressure to avoid cavitation and the introduction of gas bubbles into the print head.

It is yet another advantage of the present invention that the method reduces printer downtime and time to first print by utilizing a single sealing action of the purge cap to the print head.

It is still another advantage of the present invention that the method improves purging efficiency and effectiveness while reducing the ink required to perform the purging process.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
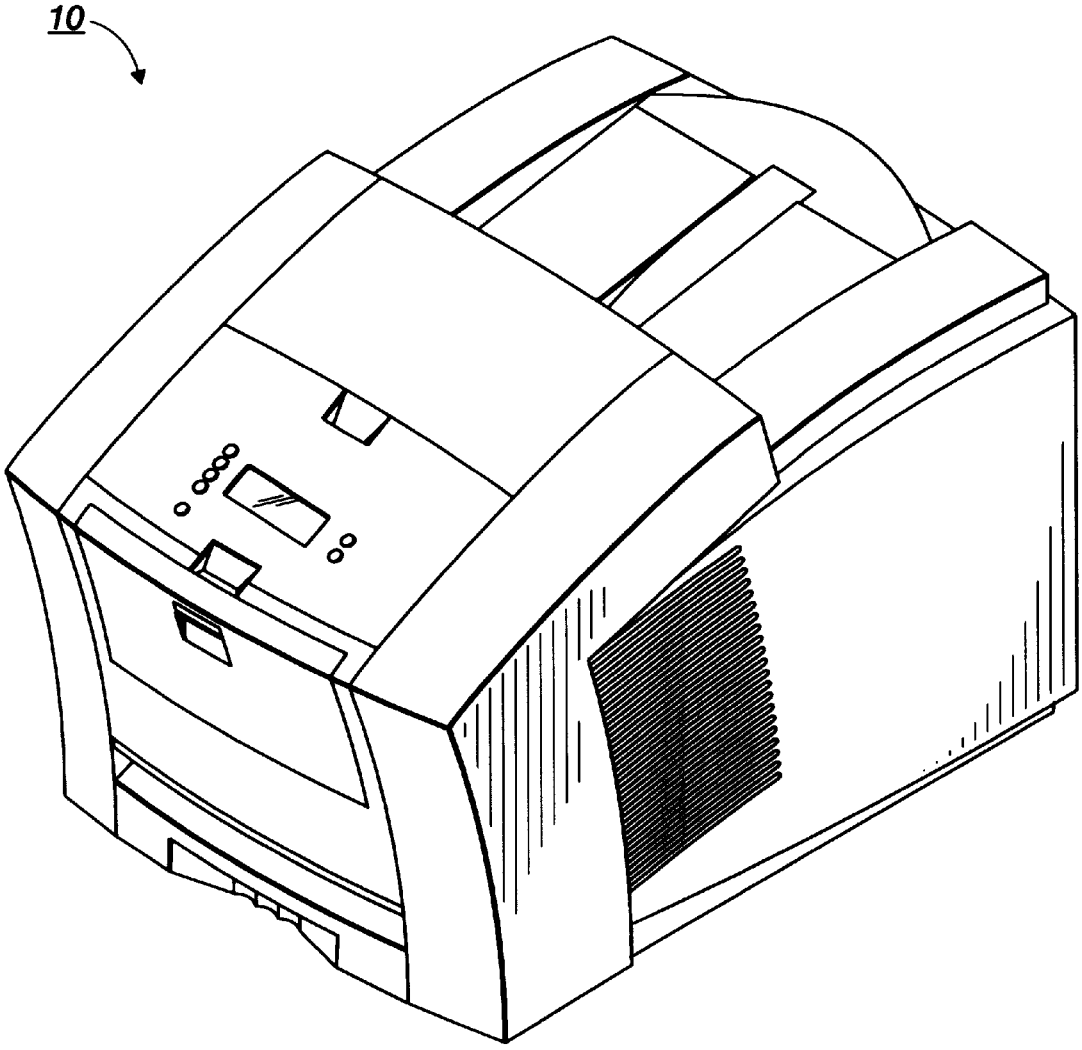
FIG. 1 is an overall perspective view of an ink jet printer that uses the method of the present invention.

FIG. 1 is an overall perspective view of an offset phase change ink jet printing apparatus, generally indicated by the reference numeral 10, that utilizes the method of the present invention. An example of an offset phase change ink jet printer is disclosed in U.S. Pat. No. 5,389,958 entitled IMAGING PROCESS, and assigned to the assignee of the present application. U.S. Pat. No. 5,389,958 is specifically incorporated by reference in its entirety. It will be appreciated that the present invention may be practiced with various other imaging apparatus that utilize an ink jet print head, such as aqueous ink jet printers and the like. Accordingly, the following description will be regarded as merely illustrative of one embodiment of the present invention.

Figure 2:
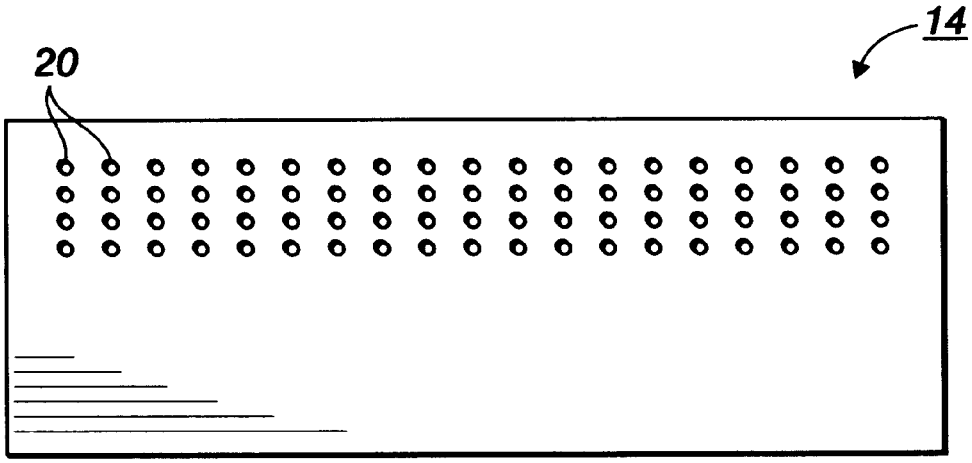
FIG. 2 is front plan view of an orifice plate in an ink jet print head.

FIG. 2 shows a front plan view of an orifice plate 14 that forms part of an ink jet print head (not shown). An example of a suitable ink jet print head is found in U.S. Pat. No. 5,677,718 entitled DROP-ON-DEMAND INK JET PRINT HEAD HAVING IMPROVED PURGING PERFORMANCE, and assigned to the assignee of the present application. U.S. Pat. No. 5,677,718 is specifically incorporated by reference in its entirety. The orifice plate 14 includes multiple rows of multiple orifices 20. The print head ejects ink from orifices 20 to create an image on an intermediate transfer surface (not shown), such as silicone oil. The image is then transferred to a final receiving medium, such as a sheet of paper.

Figure 3:
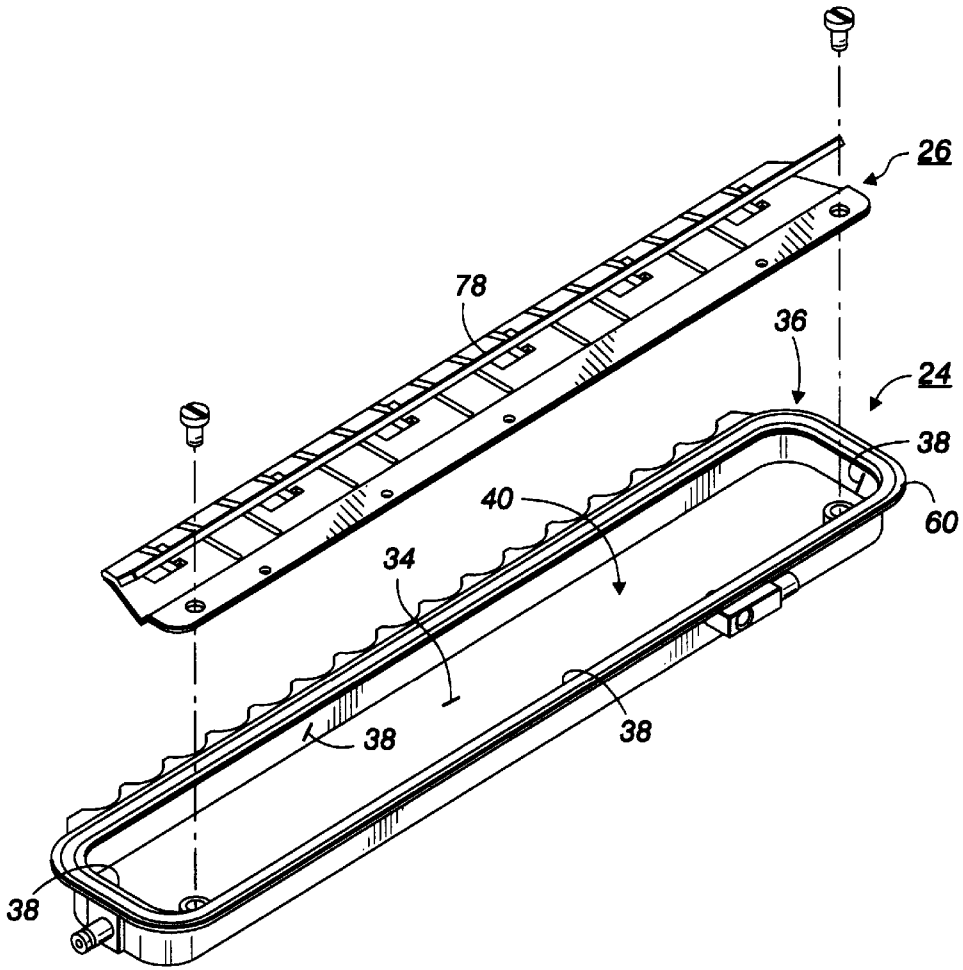
FIG. 3 is a front elevational view of a purge cap and wiper assembly that may be used to practice the present invention.

In its broadest aspects, the present invention is directed to a method for cleaning an ink jet print head by drawing contaminants from the print head orifices and then wiping the contaminants from the orifice plate. FIG. 3 illustrates a purge cap 24 and wiper assembly 26 that may be utilized to practice the method of the present invention. The purge cap 24 includes an open end 36 and a recessed region 40 defined by a rear wall 34 and bordered by side walls 38. The side walls 38 have top side margins that define the periphery of the open end 36. The length of the purge cap 24 spans the region of the orifice plate 14 that contains the ink jet orifices 20. A seal 60 positioned around the periphery of the purge cap 24 provides a vacuum seal between the purge cap and the region of the orifice plate containing the orifices 20 when a positioning system (not shown) urges the orifice plate 14 against the purge cap 24.

Figure 4:
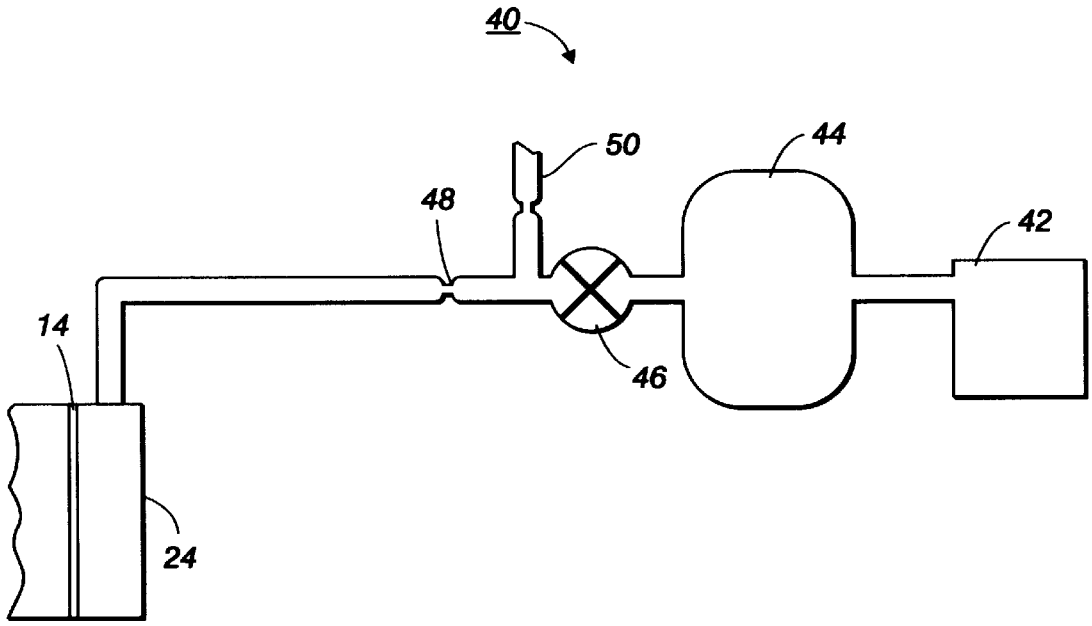
FIG. 4 is a schematic diagram of a vacuum system utilized to create negative pressure within the purge cap.

With the orifice plate 14 urged against the purge cap seal 60, a heater connected to the purge cap heats ink solidified in the orifices 20. With reference now to FIG. 4, a vacuum system 40 is pneumatically connected to the purge cap 24. The vacuum system 40 creates a pressure differential across the orifices 20 to draw the molten ink and debris out of the orifices, onto the orifice plate 14 and into the purge cap 24. The vacuum system 40 includes a pump 42, an accumulator 44, a valve 46, a flow restrictor 48 between the valve and the purge cap 24, and a bleed restrictor 50. As described in more detail below, the pump 42 first creates a vacuum within the accumulator 44. The valve 46 is then opened for a predetermined period of time to create a negative pressure or vacuum pulse within the purge cap 24.

Returning to FIG. 3, the resilient wiper assembly 26 positioned in the recessed region 40 of the purge cap 24 includes a wiper blade 78 that extends along the length of the purge cap and nominally outwardly of the recessed region. When the positioning system urges the orifice plate 14 against the purge cap seal 60, the orifice plate forces the wiper 78 to retract from its nominal position and rearwardly into the recessed region 40 while still contacting the orifice plate 14. The positioning system then moves the purge cap 24 downwardly and against the orifice plate 14 so that the wiper blade 78 wipes the contaminates from the region of the orifice plate containing the orifices 20. A more detailed description of the print head cleaning method and apparatus described above is found in the above-referenced U.S. Pat. No. 5,570,117. U.S. Pat. No. 5,570,117 is hereby incorporated by reference in its entirety.

Figure 5:
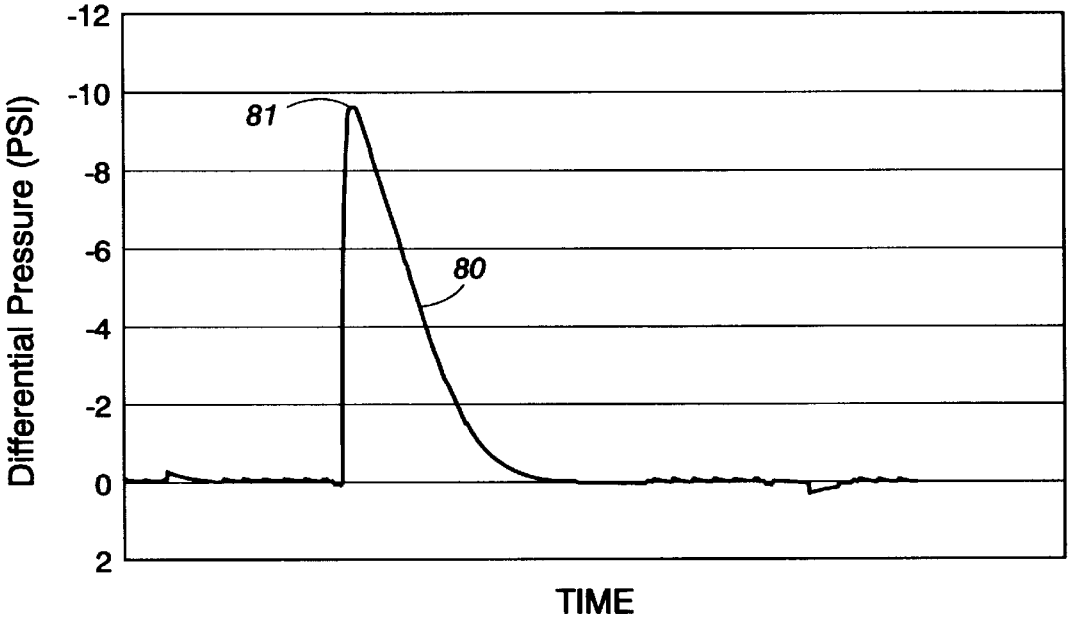
FIG. 5 is a graphical representation of a prior art purging vacuum pressure profile.

With reference now to FIG. 5 of the present application, an example of a prior art vacuum pressure profile that may be utilized with the cleaning sequence described in U.S. Pat. No. 5,570,117 is illustrated. This prior art method utilizes a single vacuum pressure pulse 80 with a peak pressure 81 of between about −9.5 psig and about −11.5 psig. To achieve this vacuum pressure, the orifice plate is urged against the purge cap and a limited duration vacuum is created by the action of a separate vacuum reservoir, pump and activation valve. The time from valve open to the peak vacuum pressure is approximately 0.375 seconds, with a decaying vacuum profile following the peak pressure and lasting for about 7 seconds.

In this prior art method, the sharp rising spike in the vacuum profile was found to be effective in shocking loose trapped gas bubbles from the internal walls of the print head. At the conclusion of the vacuum cycle, the wiping action of the wiper blade is used to remove the excess ink from the surface of the orifice plate. This vacuum cycle and wiping action is typically repeated twice during a printer power-up operation, and the purge cap seal against the orifice plate is disengaged and reengaged between vacuum cycles to allow waste ink to be emptied. In this method, the net weight of ink expelled during a power-up purging operation is typically in the range of about 20 grams.

While the above described method is generally effective in purging the jets of the print head, it nevertheless contains certain drawbacks. For example, utilizing a peak vacuum pressure in the range of −10 psig can cause cavitation within the print head, thereby introducing additional gas bubbles within the liquefied ink in the print head. The required separation of the purge cap between vacuum cycles also extends the time required for the purging operation and power-up. It would also be desirable to reduce the amount of ink used in the purging process and to improve purging efficiency.

Figure 6:
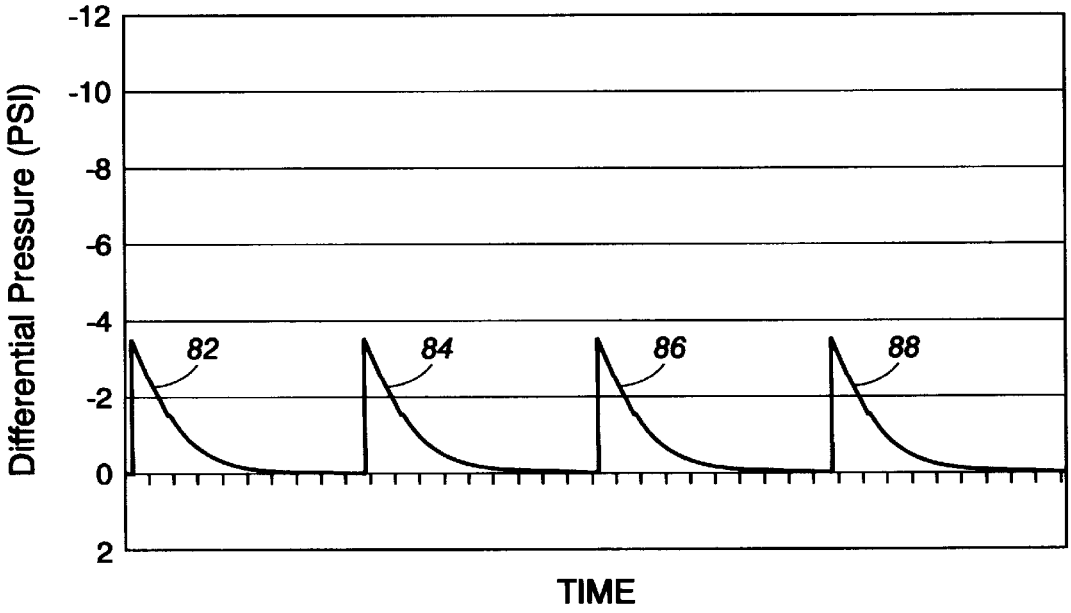
FIG. 6 is a graphical representation of a preferred purging vacuum pressure profile that utilizes multiple low pressure vacuum purging pulses.

The present invention improves upon the methods of the prior art by providing multiple low pressure differential vacuum pulses in a single purging process. With reference now to FIG. 6, an example of a vacuum pressure profile of the present invention is illustrated. Once the purge cap 24 has engaged the orifice plate 14 to form a vacuum seal, four low pressure differential vacuum pulses 82, 84, 86 and 88 are generated within the purge cap. Preferably, each pulse has a peak pressure of between about −2.5 psig and about −8.0 psig, and most preferably about −3.6 psig. The peak pressure is maintained for a period of between about 0.2 seconds and about 3 seconds, and preferably about 0.375 seconds. Advantageously, each vacuum pulse retains a sharp rising profile to ensure that trapped gas bubbles are shocked loose from the internal surfaces of the print head.

To retain the sharp rising profile of the pressure pulse while simultaneously limiting the peak pressure within the purge cap to about −3.6 psig, a higher vacuum pressure is generated in the accumulator 44, and the valve timing and flow restrictor are utilized to obtain the desired pressure profile. In one embodiment, a vacuum pressure of about −10 psig or greater is created in the accumulator 44. The valve 46 between the accumulator 44 and the purge cap 24 is opened for a defined period, preferably between about 0.2 seconds and about 0.5 seconds. With the flow restrictor 48 and bleed restrictor 50 positioned between the accumulator 44 and the purge cap 24, this configuration may be utilized to create the pressure profile illustrated in FIG. 6.

Additionally, and in an important aspect of the present invention, utilizing a lower peak vacuum pressure of between about −2.5 psig and about −8.0 psig avoids cavitation within the print head to thereby prevent the creation of additional gas bubbles inside the print head. It will also be appreciated that a number of low pressure differential vacuum pulses other than four, including but not limited to two, three or five pressure pulses, may be utilized in practicing the present method.

Utilizing multiple lower peak vacuum pressures also reduces the amount of ink expelled during the purging operation. For example, as compared to the prior art purging method described above, the present method has been demonstrated to expel up to 83% less ink for a complete purging operation.

Reducing the amount of ink expelled during the purging operation has numerous advantages. For example, fewer user interventions are required to replace or empty a waste ink receptacle or to refill the ink supply. This also reduces warmup time for the printer, as the print head will require additional ink less often. Additionally, reducing the amount of purged ink allows for the entire purging operation to occur without unsealing the purge cap from the orifice plate to remove purged ink from the cap. By performing all of the low pressure vacuum pulses under a single sealing action of the purge cap to the orifice plate, unnecessary motion of the purge cap and print head is reduced. This in turn reduces the opportunities for introducing air back into the print head, and limits printer standby time and the delay to first print.

Additionally, the present method has demonstrated a purging efficiency of about 85%, compared to the prior art method efficiency of about 75%. Providing multiple vacuum pressure pulses in a single purging operation also allows for multiple opportunities to overcome trapped bubble surface tension within the print head and to remove the trapped bubbles from internal surfaces in the print head.

After each peak vacuum pulse, the bleed restrictor 50 is utilized to reduce the vacuum pressure differential across the orifices until the orifices experience approximately ambient pressure. The vacuum pressure differential is preferably reduced over a pressure decay period of between about 1 second and about 15 seconds, and most preferably about 1.7 seconds. After the pressure decay period, the orifices are maintained at approximately ambient pressure for a period of between about 3 seconds and about 45 seconds, and preferably about 8 seconds, before the next pressure pulse is applied. Advantageously, this time gap between pressure pulses ensures that each pulse creates the maximum pressure shock within the print head to shock free the trapped air bubbles from the internal surfaces of the print head.

To further improve the purging performance of the present method, a negative pressure is created within the recessed region of the purge cap prior to the step of urging the purge cap and the orifice plate together. Alternatively expressed, the vacuum system is activated before the purge cap contacts the orifice plate. Advantageously, this pre-sealing suction prevents air from being pushed into the orifices upon sealing the purge cap to the orifice plate.

It will be appreciated that other ink jet print head constructions and ink jet printer architectures may be utilized in practicing the present invention. The method and apparatus of the present invention may also be practiced to jet various fluid types including, but not limited to, aqueous and phase-change inks of various colors.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printer, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A method of cleaning an ink jet print head, the ink jet print head including an orifice plate having a plurality of orifices through which ink is ejected, the method comprising the steps of:

(a) positioning a purge cap adjacent to the plurality of orifices, the purge cap having a closed end and an open end that defines a recessed region therebetween, the purge cap having a seal positioned around a periphery of the open end;

(b) urging the seal of the purge cap and the orifice plate against each other so that the seal engages the orifice plate and encloses the plurality of orifices;

(c) creating a vacuum pressure differential across the orifices that causes liquefied ink present in the orifices to deposit onto the orifice plate;

(d) releasing the vacuum pressure differential across the orifices until the orifices experience approximately ambient pressure;

(e) repeating steps (c) and (d) at least two times, while maintaining the purge cap in contact with the orifice plate; and (f) withdrawing the purge cap from contact with the orifice plate.

2. The method of cleaning an ink jet print head of claim 1, wherein step (c) further comprises the step of creating a peak vacuum pressure differential of between about −2.5 psig and about −8 psig across the orifices.

3. The method of cleaning an ink jet print head of claim 1, further including the step of maintaining the vacuum in step (c) for between about 0.2 seconds and about 3 seconds.

4. The method of cleaning an ink jet print head of claim 1, wherein step (d) further comprises the step of reducing the vacuum pressure differential across the orifices over a pressure decay period of between about 5 seconds and about 15 seconds.

5. The method of cleaning an ink jet print head of claim 1, further including the step of maintaining the orifices at approximately ambient pressure for a period of between about 3 seconds and about 45 seconds after each repetition of step (d).

6. The method of cleaning an ink jet print head of claim 1, further including the step of drawing about 12 grams or less of ink from the orifices in performing steps (a)–(f).

7. The method of cleaning an ink jet print head of claim 1, further including the step of creating a negative pressure within the recessed region of the purge cap prior to the step of urging the purge cap and the orifice plate against each other.

8. A method of creating a negative pressure within a purge cap that forms a vacuum seal with an orifice plate of an ink jet print head, the purge cap being pneumatically connected to an accumulator, the method comprising the steps of:

(a) accumulating a vacuum pressure of about −10 psig or greater in the accumulator;

(b) opening a valve between the accumulator and the purge cap;

(c) restricting air flow between the accumulator and the purge cap;

(d) creating about −4 psig pressure or less within the purge cap; and (e) closing the valve after a predetermined amount of time.

9. The method of creating a negative pressure within a purge cap of claim 8, further including the step of providing a flow restrictor between the valve and the purge cap.

10. The method of creating a negative pressure within a purge cap of claim 8, wherein step (d) further comprises the step of closing the valve after a period of between about 0.2 seconds and 0.5 seconds.

* * * * *